United States Patent [19]

Linecker

[11] 3,939,504

[45] Feb. 24, 1976

[54] SWIMMING-POOL STRUCTURE

[76] Inventor: Josef Linecker, Rosengasse 5, 5230 Mattighofen, Austria

[22] Filed: June 20, 1974

[21] Appl. No.: 481,480

[30] Foreign Application Priority Data

June 22, 1973 Austria ..... 5524/73

[52] U.S. Cl. ..... 4/172.17; 4/172.19

[51] Int. Cl.[2] ..... E04H 3/18

[58] Field of Search ..... 4/172, 172.15, 172.16, 4/172.17, 172.19, 1, 191, 146, 152, 181; 210/169; 119/5

[56] References Cited

UNITED STATES PATENTS

| | | | |
|---|---|---|---|
| 2,410,338 | 10/1946 | Craine | 52/169 X |
| 3,157,597 | 11/1964 | Burba | 4/172.17 X |
| 3,829,910 | 8/1974 | Kaufman | 4/172 |
| 3,846,850 | 11/1974 | Banchi | 4/172.19 |

FOREIGN PATENTS OR APPLICATIONS

| | | | |
|---|---|---|---|
| 201,829 | 8/1957 | Austria | 4/172.17 |

*Primary Examiner*—Richard E. Aegerter
*Assistant Examiner*—Stuart S. Levy
*Attorney, Agent, or Firm*—Karl F. Ross; Herbert Dubno

[57] ABSTRACT

A swimming pool is formed of a plurality of interconnected and contiguous wall and bottom plates some of which are formed with ducts adapted to conduct water into the pool. These plates are formed at the ducts with a plurality of nozzles which direct a flow of water generally upwardly and toward the center of the pool for most efficient water exchange. The ducts are formed as channels between the edges of the contiguous plates and are capped with long cover elements having flanges engaged in grooves in the confronting inside flanks of the channels. The plates are joined together in the duct-forming channels at inwardly bent lips that are bolted together to either side of a resilient seal.

6 Claims, 14 Drawing Figures

SWIMMING-POOL STRUCTURE

FIELD OF THE INVENTION

The present invention relates to a pool and, more particulary, to a basin structure adapted for use as a swimming pool.

BACKGROUND OF THE INVENTION

Basin structures for swimming pools are known which are formed in situ out of concrete. It has been found to be impossible to make a rugged swimming pool out of concrete slabs or the like because the conventional joints inevitably leak. One of the principal disadvantages of the concrete pool is that it must be repainted yearly. This is a difficult and expensive operation which can only be carried out in clear and warm weather, so that the swimming pool is inevitably unusable during a period when its use is most desired.

It is also known to make a swimming pool out of a plurality of metal, usually steel, plates which are welded together. The disadvantage of such a structure is that it is very sensitive to heat deformation. Heat generated by welding frequently deforms the plates when they are connected together and, when part of the pool is in shadow and part in sunlight the structuure frequently deforms to the point of breaking. In addition it is impossible to make such a structure in the colder months of the year, as the inevitable changes in dimensions that come with change of seasons will cause the various connecting pipes and the like to be ripped loose.

It is also known to make swimming pools out of relatively porous bases which are not watertight themselves, but which are covered by a watertight synthetic-resin sheet. Although such a structure is relatively inexpensive to manufacture but the sheet is frequently fragile, and once damaged the structure leaks readily.

It is also known to use relatively strong synthetic-resin sheets, usually reinforced with glass fiber, and to bolt these sheets together. The bolting is generally carried out on the outside of the basin structure so that when completed the pool has a smooth interior. The principal disadvantage of such an arrangement is that the bolts, which are buried, frequently are completely destroyed by corrosion, allowing the joints to separate and the pool to leak. In addition it can be impossible to tighten the joints in such pool, as the bolts are completely inaccessible in the finished structure.

In order to keep the water in such pools fresh and healthy it is necessary that it be continuously passed through a filter, usually with the addition of a predetermined quantity of chlorine to the water as it is circulated. Nowadays this flow is generally from one side of the pool to another. In addition it is known to inject water at the bottom of the pool and withdraw it from an overflow rim at the upper edge of the pool.

In recent years a new system has become popular wherein the water is injected in the base or floor of the pool at several locations through holes which effectively form an upwardly directed jet of purified water in the pool. Such a system, although more efficient than any of the abovementioned arrangements, has the disadvantage that in reality the water exchange is only a fraction of that which it theoretically appears to be, as the upwardly flowing jet merely forms an inverted cone of fresh water in the pool, leaving many zones virtually unaffected by the water flow. In addition the use of such systems creates the considerable danger that a leak will appear in the water-feed lines below the swimming pool or at the inlet holes. Such a leak can have disastrous consequences for the pool because it is extremely difficult to plug.

OBJECTS OF THE INVENTION

It is therefore an object of the present invention to provide an improved basin structure.

More particularly an object of this invention is to provide a swimming pool which overcomes the above-given disadvantages.

More particularly it is an object of this invention to provide a structure which can be assembled in virtually any weather, and which forms a long-lasting and structurally rigid swimming pool.

SUMMARY OF THE INVENTION

These objects are attained according to this invention in a pool comprising a plurality of interconnected and contiguous wall and bottom plates at least some of which are formed with ducts adapted to conduct water into the pool. These ducts form part of the elements constituting the swimming pool.

According to a feature of this invention these ducts are simple pipes lying against and welded to the plates constituting the swimming pool. In such arrangement, holes open from the pipes into the swimming pool and constitute the filling or inlet holes of the swimming pool.

According to a further feature of this invention each of these ducts is formed at the joint between a pair of such plates. Each of the plates of the pair is formed with a flank constituting one of the sides of a channel constituting three sides of the duct. The bottom of the duct is formed by both of the plates and a removable cover plate is engageable over the open side of the channel to close the duct. To this end each of the flanks of the channel is formed with an inwardly open groove and the cover plate has resilient flanges resiliently engageable in these grooves so as to hold this cover plate tightly in place. The pressure within the duct is relatively low, so that leakage around the cover plate will be minimal. Moderate leakage can be tolerated here as all of the flow will simply be into the swimming pool.

According to yet another feature of this invention each of plates is formed within the channel at the base thereof with an inwardly directed lip secured to the similar lip of the other plate with a bolt. A resilient seal is provided between these two lips so as to form between the plates a watertight joint which is readily accessible when the cover of the duct is removed. Assembly of such a swimming pool is a very simple matter, as the plates need merely be emplaced and then bolted together, the covers of the ducts afterwards being snapped in place.

In accordance with a further feature of this invention the cover is provided with nozzles which direct stream of water parallel to the surfaces of the plates so as to obtain a very advantageous fluid flow within the pool. According to this invention the flow is directed generally toward the center of the swimming pool so that maximum water exchange is obtained.

The plates according to yet another feature of this invention are formed with arrays of corrugations which allow them to expand and contract due to temperature changes. These corrugations are of U-section and run at right angles to one another so that stresses in virtually any direction can be taken up.

The swimming pool according to the present invention can be readily assembled and can be arranged so that virtually any pattern of fluid flow is obtained. Two of the plates constituting the side walls form an inlet duct coming from the filter pump so that all of the ductwork is effectively located inside the pool and the possibility of leakage is ruled out, while at the same time an advantageous flow from the base of the swimming pool is obtained.

BRIEF DESCRIPTION OF THE DRAWING

The above and other objects, features, and advantages of the invention will become more readily apparent from the following description, reference being made to the accompanying drawing in which.

SPECIFIC DESCRIPTION

Figures 1, 2, 3, 4, 5, 6, 7, 8, 9, 10, 11, 12, 13, 14:
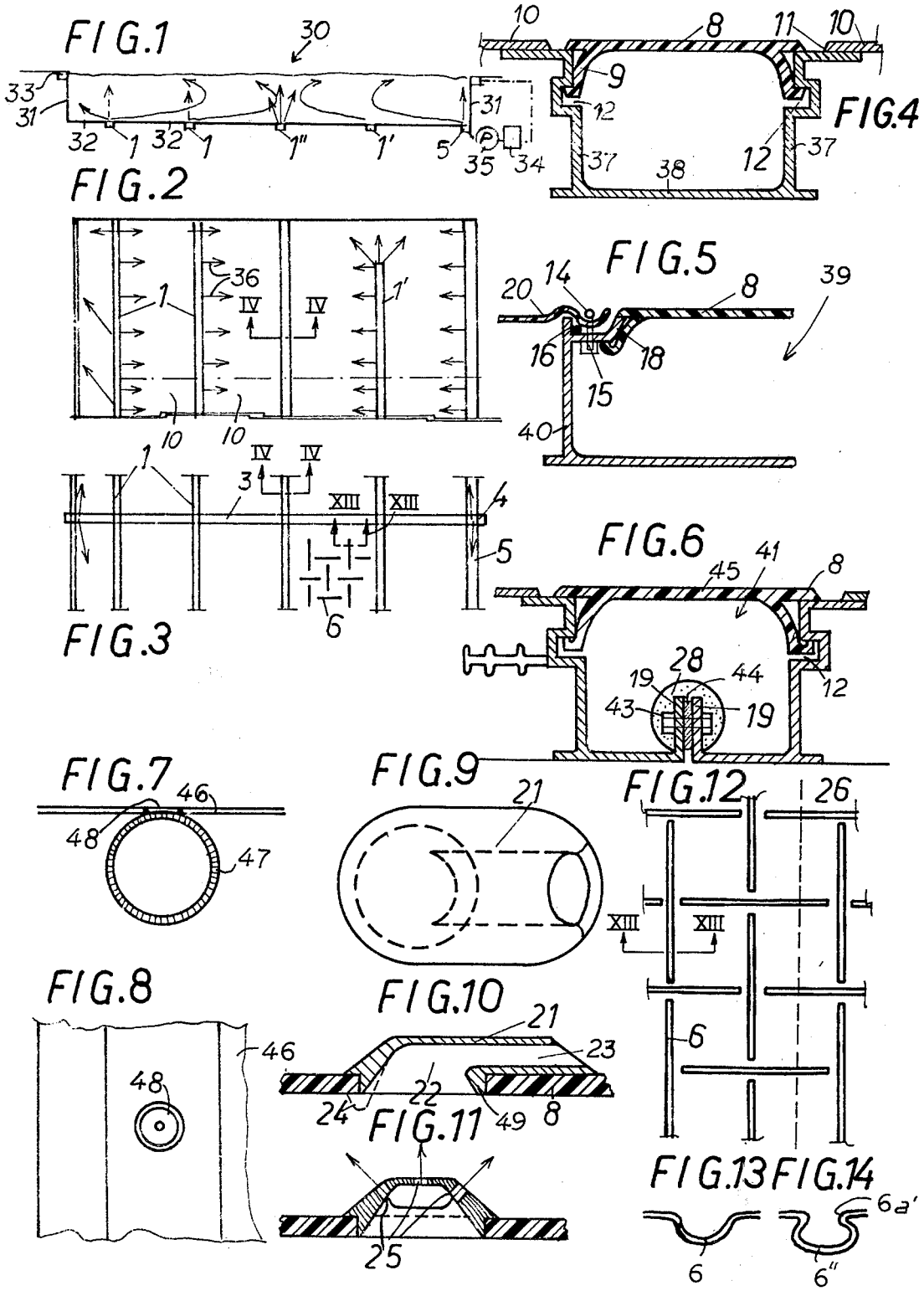
FIG. 1 is a vertical section partly in diagrammatic form through a swimming pool according to the present invention.
FIG. 2 is a top view of a portion of the pool shown in FIG. 1.
FIG. 3 is a detail view of the arrangement of FIG. 2.
FIGS. 4, 5, 6 and 7 are large-scale sectional views, seen as if taken along lines IV—IV in FIGS. 2 and 3 showing different duct configurations according to the present invention.
FIG. 8 is a top view of the element of FIG. 7.
FIGS. 9, 10 and 11 are top, longitudinal-sectional, and cross-sectional views of a nozzle usable with the arrangement of FIGS. 7 and 8.
FIG. 12 is a large-scale plan view of a portion of a plate according to this invention.
FIGS. 13 and 14 are large-scale sectional views through corrugations of a plate along line XIII—XIII as shown in FIGS. 3 or 12.

FIGS. 1–3 show a swimming pool 30 formed of a plurality of wall sections 31 and a plurality of floor or base sections 32. The base sections 32 form inlet conduits or ducts 1 and the wall plates 31 are formed with an overflow trough 33 connected to the input of a filter 34 in series with a pump 35 so that water pumped out of the outlet trough 33 passes through the filter 34 and is then forced by the pump 35 back into the pool 30 through the conduits 1 which are provided to this end with a plurality of openings 36 which are directed as shown by the arrows in FIG. 2 so as to form a flow converging on the center of the pool 30. The ducts 1 are all parallel and are interconnected by a transverse duct 3 which rises at the side of the pool in a duct 4. A duct 5 is provided directly adjacent the wall plates 31 and directs the flow of water inwardly towards the center of the pool. Another duct 1' does not extend the full length of the pool but terminates short of the end wall thereof. The central duct 1'' directs its water upwardly so that the water flow is generally toward the center from the bottom and then outwardly in the overflow trough 33. FIG. 3 also shows how the plates 32 are formed with a network of corrugations 6 which are described below.

FIG. 4 shows a duct having a pair of side walls 37 extending parallel to and confronting each other above a base wall 38. Each of these side walls 37 is formed with a groove 12 in which is received a resilient foot 9 of a synthetic-resin plate. The channel 37, 38 thus formed is welded at 11 between a pair of steel plates 10 and therefore constitutes the joint between these two plates.

FIG. 5 shows another similar arrangement where here a channel 39 is provided in each of its flanks 40 with an inwardly extending lip 18 forming a U-shaped groove in which is lain the end of a heavy synthetic-resin plate 20 which is secured therein via a screw 14 and nut 15 with a seal 16 insuring a watertight joint. In this arrangement the screw 14 and nut 15 are both fully accessible from within the pool. A cover plate 8 as described with reference to FIG. 4 is provided to close the duct (e.g. 1, 1', 1'') formed by the channel 39 and connected to the pumping system 35 etc. through the network 1, 3, 5 etc.

The arrangement of FIG. 6 is identical to that of FIG. 4 except that here a channel 41 is formed between a pair of plates having inwardly extending facing lips 19 which are joined together by bolts 43. A resilient seal 44 is received between the lips 19 and each of the bolts is embedded in a mass 28 of watertight synthetic-resin material. Removal of the high-density polyethylene cover or top 8 allows access to these bolts, while covering them under normal circumstances. FIG. 6 also shows how the cover 8 can be provided with a throughgoing hole 45 allowing water to be pumped out of the channel. The metal plates in FIGS. 4-6 are all coated with polyethylene, this polyethylene sheet being integrally bonded to the plates.

FIGS. 7 and 8 show a pool bottom plate 46 which is welded to a circular-section pipe 47 (forming the duct) which opens through the plate 46 via a round hole 48.

FIGS. 9-11 show a nozzle arrangement 21 adapted to be engaged over holes 45 in the covers 8 or in holes 48 in the plates 46. To this end each of the nozzles has a neck 49 adapted to fit within a hole 45 or 48 and comprises a laterally extending nozzle 23 formed with a throughgoing hole 22 so that water under pressure within the duct 41 is ejected in line with the nozzle 23. In addition the nozzle structure 21 is formed with holes 25 which allow a certain amount of water to escape upwardly into the sides for most complete water exchange in the pool. The nozzle structure 21 is advantageously once again made of synthetic-resin coated steel, although use of aluminum or fiber-glass reinforced synthetic resin would also be suitable. Clips as shown at 24 can be provided to allow the nozzle 23 to be snapped in place and adjusted after installation.

FIGS. 12, 13 and 14 illustrate the corrugations formed in the plates 31 and 32 constituting a swimming pool. These corrugations 6 are of simple U-cross section as shown in FIG. 13 or can be shown at 6' in FIG. 14 of omega cross section with a narrow waist 6a'. These formations allow stresses in the plates 31 and 32 to be taken up in the plane of these plates so that some of the deformations will not damage the structure.

I claim:

1. In a swimming pool the improvement which comprises:

a plurality of plates secured in substantially contiguous relationship and defining the bottom of the swimming pool, channels lying below the bottom surfaces of the plates bridging the adjacent side edges of said plates and upwardly open at the bottom of said swimming pool, said channels having outwardly extending portions at the upper end thereof for attaching adjacent sides of the bottom surfaces of said plates to said channels said channels further having flanks provided with inwardly open grooves;

respective covers closing the mouths of said channels and having downwardly extending flanges received in said grooves, said covers having planar portions substantially flush with said plates along said bottom of said pool, said covers being formed at spaced locations with orifices communicating between the interiors of said channels and said pool; transverse duct means interconnecting said channels; and recirculation means connected to said duct means for forcing water through said channels to distribute water into said pool through said orifices.

2. The improvement defined in claim 1 wherein said covers are made of a water-resistant synthetic resin.

3. The improvement defined in claim 2 wherein each of said plates is provided with an edge portion forming half of a respective one of said channels and an upstanding lip adapted to project upwardly in the base of the respective channel, means being provided for securing said lips of two adjoining plates together within the respective channel, a bead of sealing material being mounted upon the interconnecting lips to seal said plates together.

4. The improvement defined in claim 3 wherein said orifices are formed with nozzles for deflecting water in directions generally along said bottom.

5. The improvement defined in claim 3 wherein said plates are formed with corrugations of generally U cross section.

6. The improvement defined in claim 5 wherein said corrugations have a narrow waste at the shanks of the U.

* * * * *